US005823920A

United States Patent [19]

Grider

[11] Patent Number: 5,823,920

[45] Date of Patent: Oct. 20, 1998

[54] EXERCISE MACHINE

[76] Inventor: Sherman P. Grider, 14829 E. Salt Lake Ave., Industry, Calif. 91746

[21] Appl. No.: 648,307

[22] Filed: May 13, 1996

Related U.S. Application Data

[63] Continuation of Ser. No. 378,957, Jan. 26, 1995, abandoned.

[51] Int. Cl.[6] ..... A63B 21/00

[52] U.S. Cl. ..... 482/100; 482/137; 482/908

[58] Field of Search ..... 482/99–103, 137, 482/135–138, 908

[56] References Cited

U.S. PATENT DOCUMENTS

| | | | |
|---|---|---|---|
| 5,098,361 | 3/1992 | Danylieko | 482/97 |
| 5,120,289 | 6/1992 | Yu | 482/137 |
| 5,236,406 | 8/1993 | Webber | 482/100 |
| 5,263,915 | 11/1993 | Habing | 482/99 |
| 5,366,432 | 11/1994 | Habing et al. | 482/100 X |
| 5,597,257 | 1/1997 | Habing | 482/100 |

OTHER PUBLICATIONS

Paramount CTx (Brochure) 2 pages ©1990.

Hoist Fitness Systems "Multi Function Home Gym 1200" (brochure) ©1993.

*Primary Examiner*—Richard J. Apley
*Assistant Examiner*—John Mulcahy
*Attorney, Agent, or Firm*—Boniard I. Brown

[57] ABSTRACT

A support arm extends from the press arm toward the frame. A sleeve is slidably mounted on the support arm to contact the frame in the rest position. A cable and pulley system, including a pulley mounted to the sleeve, links the press arm to the resistance. Adjustment of the sleeve along the support arm adjusts the rest position of the press arm without slackening the cable.

12 Claims, 2 Drawing Sheets

FIG.1
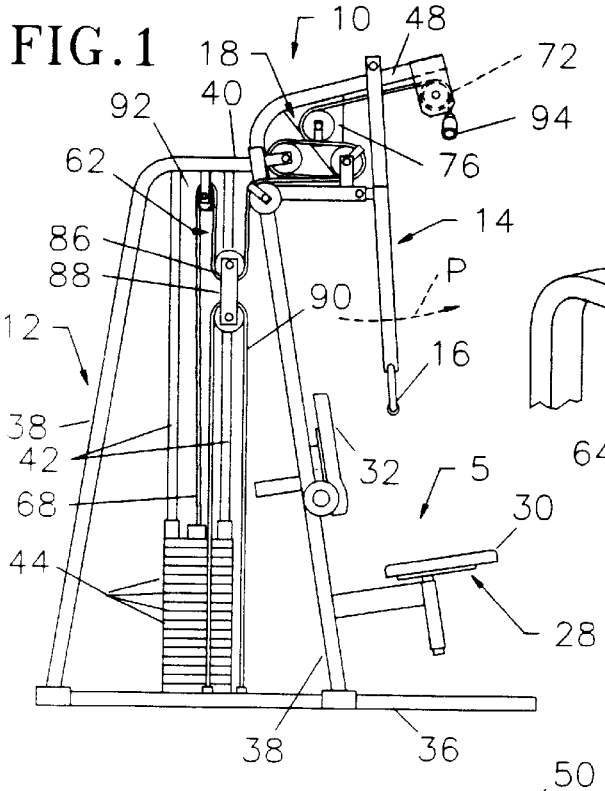
FIG.2
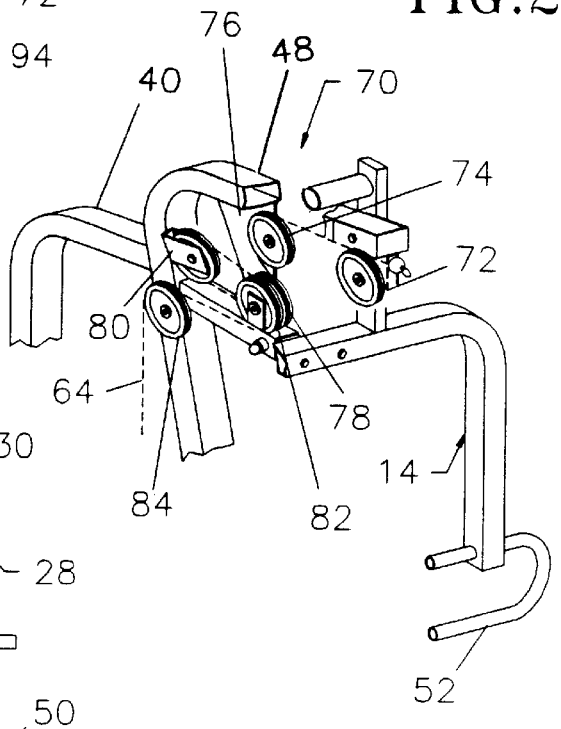
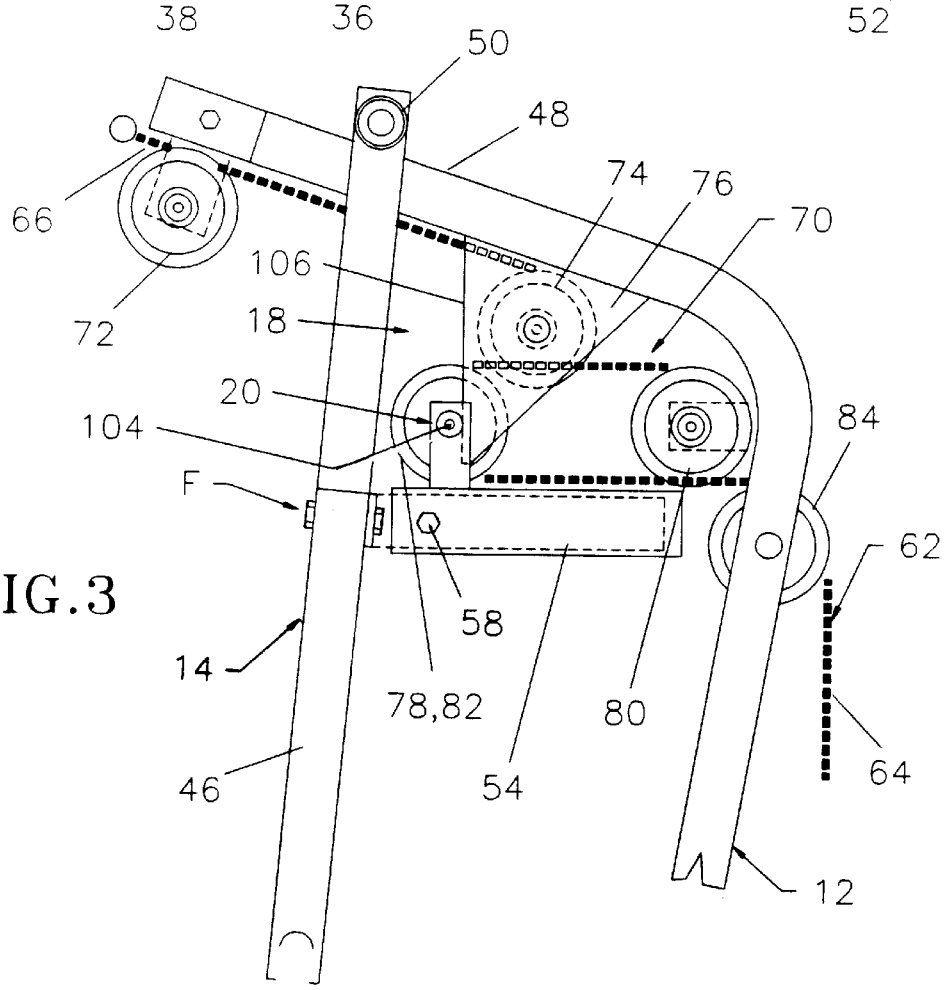
FIG.3

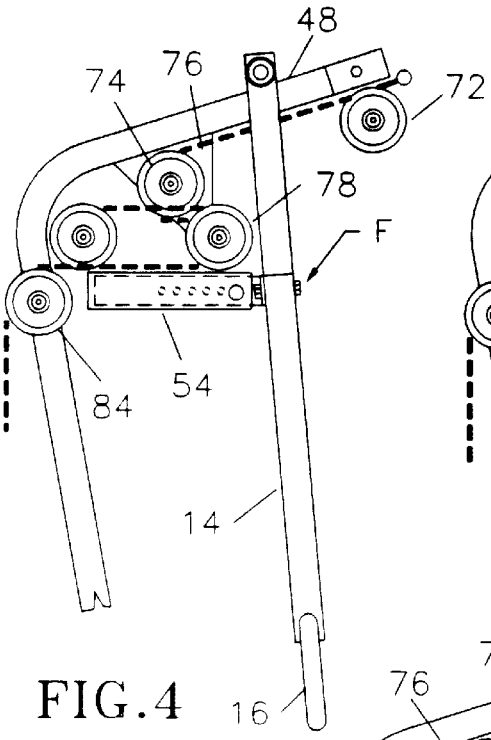
FIG.4
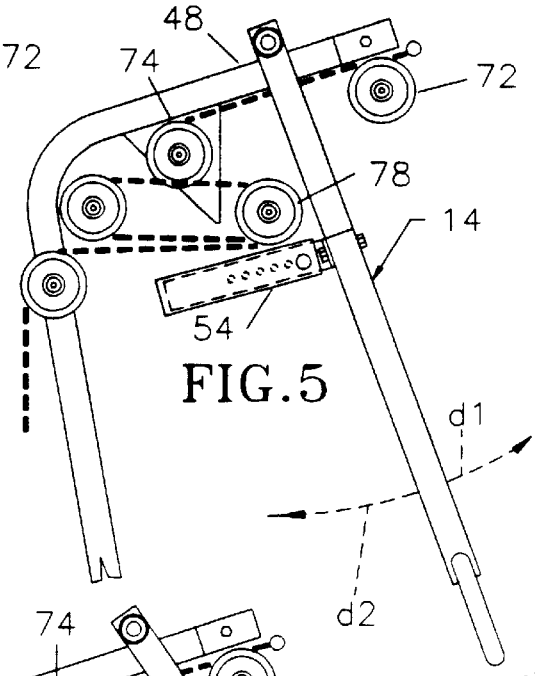
FIG.5
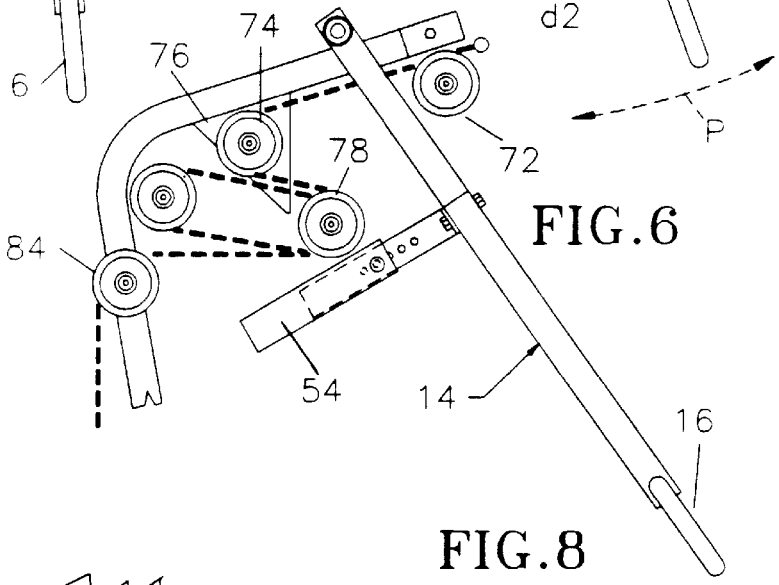
FIG.6
FIG.7
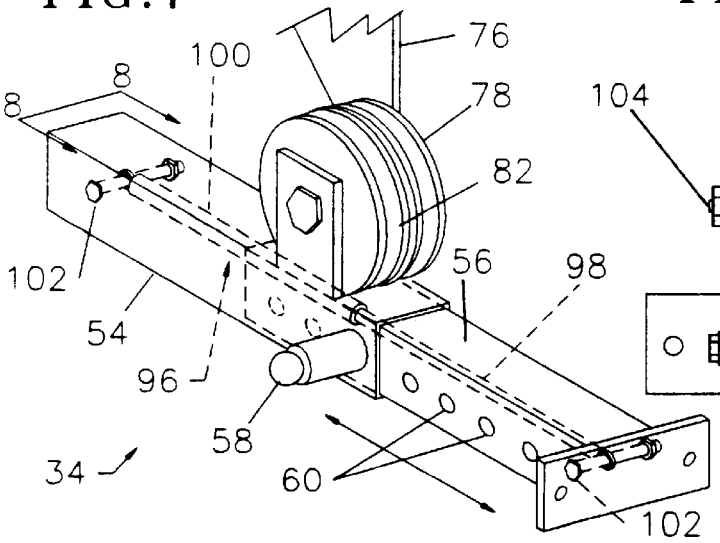
FIG.8
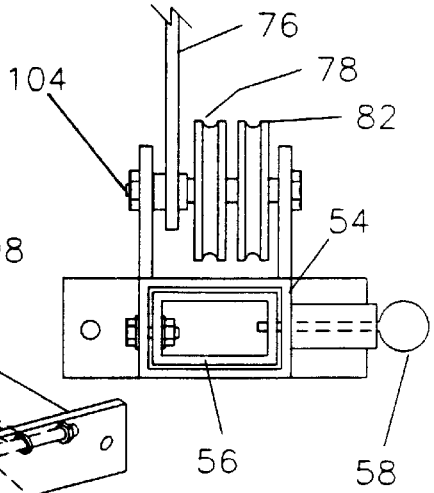

EXERCISE MACHINE

This application is a continuation of application Ser. No. 08/378,957 filed on Jan. 26, 1995, now abandoned.

BACKGROUND OF THE INVENTION

1. Field of the Invention

This invention relates generally to exercise machines of the kind having an exercise member mounted on a frame for movement by a user in a back and forth exercise motion which is resisted in one direction by a resisting force that urges the member in the opposite direction to a certain normal position relative to the position occupied by user. The invention relates more particularly to such an exercise machine wherein the normal position of the exercise member is adjustable relative to the user position to accommodate users of differing body size.

2. Discussion of the Prior Art

Many exercise machines have a frame mounting an exercise member which is movable in a back and forth exercise motion along a certain exercise path by a user situated in a normal user position relative to the frame. The exercise member includes engagable means engagable by the user for moving the member in this back and forth exercise motion, Movement of the exercise member is resisted in one direction of its exercise motion by a resisting force that urges the member in the opposite direction to a normal position along the path.

One problem associated with exercise machines of this kind is accommodating the machines to users of different body size. In this regard, consider, for example, one specific exercise machine which is currently being marketed and with which this invention is particularly concerned. For convenience, this machine is hereafter referred to as a marketed exercise machine or simply a marketed machine. This marketed machine has an upright frame mounting a seat for seating a user of the machine. The exercise member of the machine which is movable in a back and forth exercise motion by the user is a press arm having a lower free end located in front of the seat and an upper end pivotally mounted on the frame above the seat in such manner that the lower free end of the arm is moveable back and forth along an arcuate exercise path toward and away from the seat. On the lower end of the press arm are handgrips to be grasped by the user for moving the arm in a back and forth swinging motion along the path.

Movement of the exercise arm along its exercise path in a direction away from the seat is resisted by weight means on the frame connected to the arm by a cable and pulley system in such manner that the weight means urges the arm toward the seat to a limiting position at which the arm engages a limit stop to locate the arm in a normal position relative to the seat. This cable and pulley system includes a cable anchored at one end to the frame and attached at the other end to the weight means and pulleys supporting the cable. These pulleys include opposing pulleys mounted on the frame and press arm, respectively, which undergo relative movement toward and away from one another during back and forth exercise motion of the press arm and around which the cable is looped in such a way that this relative movement of the opposing pulleys raises and lowers the weight means. A user of the exercise machine sits on the seat facing forwardly toward the lower end of the press arm. The user then grasps the handgrips on the lower end of the press arm and alternately bends his arms at the elbows and straightens his arms to move the press arm in a back and forth exercise motion through a range between its normol position and a limiting position beyond the normal position.

In the case of this marketed exercise machine, the problem referred to above involves the fact that the normal position of the press arm along its path of back and forth exercise motion is fixed and non-adjustable. As a consequence, the exercise machine cannot be used with the same ease and efficiency by users of different body size. That is to say, if the normal position of the press arm along its path of exercise motion is properly set for a user with relatively long arms, the normal position will be too far from the seat for a person with relatively short arms. Conversely, if the normal position of the press arm along its path of exercise motion is properly set for a user with relatively short arms, the normal position will be too close to the seat for a person with relatively long arms. Accordingly, any setting of the normal position will be a compromise for users of at least certain body sizes. Other existing exercise machines of the class described suffer from the same or similar problem. Accordingly, there is a definite need for an improved exercise machine of the class described which is not subject to the problem.

BRIEF DESCRIPTION OF THE INVENTION

This invention provides such an improved exercise machine. More specifically, the invention provides an exercise machine having a frame, an exercise member mounted on the frame having engagable means engagable by a user of the machine for moving the member in a back and forth exercise motion along a certain path, resisting means exerting a resisting force on the member for resisting movement of the exercise member in one direction of its exercise motion and urging the member in the opposite direction along the path, limit stop means for limiting movement of the exercise member in said opposite direction to a normal position, and means for adjusting this normal position along the path of movement of the exercise member in order to accommodate maximum efficiency use of the machine by persons of different body size.

The preferred inventive embodiment described herein is similar in many respects to the marketed exercise machine mentioned above, and like the latter machine, has a seat on the machine frame for seating the user and a pivotal exercise member which is swingable toward and away from the seat. Unlike the exercise member of the marketed machine, the exercise member of the preferred embodiment includes a first part in the form of a press arm and a second bracket part mounted on the press arm for adjustment of the arm in the direction of movement of the exercise member to certain fixed positions relative to the bracket part. The press arm has a lower free end located in front of the seat and an upper end pivotally mounted on the frame over the seat for pivotal movement of the arm toward and away from the seat.

In the preferred embodiment of the exercise machine, the resisting force which resists movement of the exercise member in one direction of its exercise motion is exerted on the bracket part of the exercise member and urges this part, and hence the press arm, in the opposite direction of the exercise motion. The limit stop of the machine is engagable with the bracket part and limits its movement in said opposite direction to a certain fixed limiting position at which the press arm occupies a normal position along its path of exercise motion. The press arm is adjustable relative to the bracket part to adjust the normal position of the press arm along its path of exercise motion when the bracket part occupies its limiting position.

The resisting means of the preferred embodiment is similar in certain respects to that of the marketed exercise machine and comprises weight means on the frame and a cable/ pulley system connecting the weight means to the bracket part of the exercise member including opposing pulleys on the frame and press arm bracket part, respectively, and a cable looped around these pulleys. Movement of the press arm from its normal position moves these opposing pulleys apart to elevate the weight means and thereby exert a resisting force on the press arm.

BRIEF DESCRIPTION OF THE DRAWINGS

FIG. 1 is a side elevation of a preferred exercise machine according to the invention;

FIG. 2 is a fragmentary perspective view of an upper portion of the exercise machine;

FIG. 3 is an enlarged side elevation of the upper portion of the exercise machine looking at the machine from the opposite side in FIG. 1;

FIGS. 4 through 6 illustrate the operation of the exercise machine;

FIG. 7 is an enlarged fragmentary perspective view of the adjustment means of the exercise machine for adjusting the normal position of its exercise member; and FIG. 8 is a section taken on line 8—8 in FIG. 7.

DESCRIPTION OF THE PREFERRED EMBODIMENT

Referring now to these drawings, the illustrated exercise machine 10 has a frame 12 on which is mounted an exercise member 14 movable along a certain exercise path P (FIG. 5). This exercise member includes engagable means 16 engagable by a user of the machine situated at a user station S for moving the member in a back and forth exercise motion along said path.

Connected to the exercise member 14 are resisting means 18 comprising force exerting means for exerting on the member a resisting force F which resists movement of the member in one direction d1 (FIG. 5) along its path P, hereafter referred to as a forward direction, and urges the exercise member in the opposite direction d2 along the path, hereafter referred to as a rearward direction. Limit stop means 20 limit movement of the exercise member in the rearward direction d2 along the path P. The resisting force F urges the exercise member 14 in the rearward direction to and normally yieldably retains the member in a certain position (FIGS. 1, 2, 4) along the path P. This position of the exercise member is referred to herein as its normal position. The resisting force F resists forward movement of the exercise member throughout a range of movement along the path P between its normal position of FIGS. 1, 2, 4 and a terminal position (FIG. 6) spaced in the direction d1 from the normal position.

A user of the exercise machine 10 occupies a certain exercise position at the exercise station S of the machine and moves the exercise member 14 in a back and forth exercise motion. The particular exercise machine illustrated has a seat 28 including a seat portion 30 proper and a backrest 32 mounted on the frame 12 at the exercise station S for seating the user in a sitting position with the user facing in the forward direction of the machine (i.e. to the right in FIG. 1). As explained in more detail presently, the seated user engages the engagable means 16 and moves the exercise member 14 in a back and forth exercise motion against the resistance of the resisting force F.

The basic exercise machine structure described to this point is essentially identical to and is used in much the same way as the marketed exercise machine referred to earlier. According to an important improvement feature of the present invention, the exercise machine 10 has range of motion adjustment means 34 for adjusting the normal position (FIG. 1, 3, 4) of the exercise member 14, and more importantly the normal position of the user engagable means 16 on the member, along the path P of motion in the manner discussed later for the purpose accommodating the machine to users of differing body size.

The preferred exercise machine 10 of the invention illustrated in the drawings will now be described in more detail. The machine frame 12 comprises a base 36 mounting upright frame members 38 rigidly joined at their upper ends by a connecting frame portion 40 to form a rigid frame structure. Extending vertically between and rigidly joined at their upper and lower ends to the connecting frame portion 40 and the frame base 36 are guide rods 42. Slidably mounted on these rods are a stack of weights 44 which provide the resisting force F of the resisting means 18 for resisting forward movement of the exercise member 14 along its path P.

The exercise member 14 of the preferred exercise machine 10 has upper and lower portions and comprises a lower first part 46 (FIG. 3) in the form of a press arm having normally upper and lower ends. The upper end of the press arm is pivotally mounted on the upper portion of the frame 12 above the seat 28 which is mounted on the lower portion of the frame. This upper press arm end is pivotally secured to a cantilever support arm 48 of the frame 12 which extends from the upper end of the frame forwardly over the seat. The press arm hangs downwardly in front of the seat, that is to the right of the seat back 32 in FIG. 1. The press arm 46 is swingable about a pivot axis 50 normal to the plane of the paper in FIG. 3 so that the lower end of the arm is movable toward and away from the seat 28 along an arcuate path P parallel to the plane of the paper in FIG. 3. The user engagable means 16 of the exercise member comprise a pair of hand grips 52 (only one shown) at the lower end of the press arm 46.

The exercise member 14 includes a second bracket part 54 in the form of a rectangular sleeve slidable on a rectangular support arm 56 secured to the press arm 46 near the upper pivoted end of the press arm. The support arm 56 is rigidly secured at one end to and extends laterally and rearwardly from the rear side of the press arm 46, that is the left side of the arm in FIGS. 1 and 4–6. The sleeve 54 carries a pin 58 which is selectively insertable into holes 60 in the support arm 56 to secure the sleeve in any one of several adjusted positions along the support arm. As will be understood from the ensuing description, the sleeve 54, support arm 56, pin 58, and holes constitute the range of motion adjustment means 34.

In addition to the weights 44, the resisting means 18 of the exercise machine 10 includes a force transmission means 62 in the form of a cable and pulley system connecting the weights 44 to the bracket part or sleeve 54 of the exercise member 14. This cable and pulley system includes a cable 64 having one end 66 extending along the under side of and attached to the upper frame support arm 48 which supports the press arm 46 and an opposite end 68 attached to the uppermost weight 44 in the stack of weights. The weight stack includes conventional means, not shown, for connecting any desired number of the weights to the upper weight in order to vary the total mass of the weights attached to the cable. For convenience in this disclosure, it will be assumed that only the upper most weight in the weight stack, hereafter referred to simply as "the weight", is attached to the cable. Between its ends, the cable is trained about and supported by an arrangement 70 of pulleys in a manner such that forward movement of the press arm 46 toward its position of FIG. 6 raises the weight 44 and rearward movement of the press arm toward its position of FIG. 4 lowers the weight.

Except as noted below, the pulley arrangement 70 is essentially identical to that used in the marketed exercise machine and includes the following pulleys around which the cable 64 passes, in the order set forth below, from the cable end 66 to the cable end 68: pulley 72 on the underside of the upper frame support arm 48 at the outer free end of this arm, pulley 74 located between the upper end of the press arm 46 and the inner end of the upper frame support arm 48 and mounted on the lower end of a plate 76 rigidly secured to and depending below the frame support arm 48, pulley 78 mounted on the upper side of the bracket sleeve 54 of the exercise member 14, pulley 80 mounted on the front of the frame 12 at the inner end of the frame support arm 48 opposite and rearwardly of the pulley 78, pulley 82 mounted on the upper side of the bracket sleeve 48 coaxially mounted on a common shaft with the pulley 78, pulley 84 mounted on the side of the frame 12 just-below the pulley 80, pulley 86 located below pulley 84 and mounted on a bracket 88 attached by a cable 90 to the base 36 of the frame 12, and a pulley 92 located above pulley 86 and mounted on the under side of the upper frame portion 40 above the stack of weights 44. Cable 64 passes over the pulleys 72, 74, then downwardly and forwardly to pulley 78 and around this pulley to pulley 80, then downwardly around pulley 80 and forwardly to pulley 82, then downwardly around pulley 82 and rearwardly to pulley 84, then around pulley 84 and downwardly to pulley 86, then around pulley 86 and upwardly to pulley 92, and finally upwardly over pulley 92 and downwardly to the upper weight 44.

As shown in FIG. 2, the plane of pulley 80 is disposed at an angle relative to the parallel planes of pulleys 78, 82 such that the upper edge of pulley 80 is aligned with pulley 78 and the lower edge of pulley 80 is aligned with pulley 82 to provide smooth transfer of the cable between these pulleys. As shown in FIG. 1, the plane of pulley 92 is inclined at an angle relative to the plane of pulley 86 such that one vertical edge of pulley 92 is aligned with pulley 86 and the other vertical edge of the pulley 92 is located approximately over the center of the weight stack to provide smooth passage of the cable between these pulleys and smooth elevation and lowering of the weight 44. Attached to the upper end 66 of the cable 64 is a handle 94 which prevents rearward passage of this cable end between the upper frame support arm 48 and the pulley 72 and effectively anchors this cable end to the frame during use of the press arm 46.

From the above description of the cable and pulley system 62, it is evident that the cable 64 is looped around the pair of pulleys 78, 82 on the press arm bracket 54 and the opposing pulley 80 on the machine frame 12. During back and forth motion of the press arm 46 along its path P of swinging movement with the bracket 54 fixed to the arm by engagement of the bracket pin 58 in one of the holes 60 in the bracket support 56, the pulley pair 78, 82 on the bracket move with the press arm toward and away from the opposing frame-mounted pulleys 80, 84 in the manner illustrated in FIGS. 4–6. This relative movement of the opposing pulleys 78, 82 and 80, 84 lengthens and shortens the cable runs extending between these pulleys and thereby raises and lowers the weight 44. Thus, forward movement of the press arm 46 to the right in FIGS. 4–6 raises the weight and rearward movement of the press arm to the left in these figures lowers the weights.

Except for the adjustability of the pulleys 78, 82 relative to the press arm 46, the cable and pulley assembly 70 described above is essentially identical to that used on the marketed exercise machine mentioned earlier. This pulley adjustability constitutes an important feature of this invention which enables adjustment of the normal position of the press arm along its path P of movement in the manner discussed below. Suffice it to say at this point that when the bracket 54 is fixed to the press arm 46, the cable and pulley assembly 70 constitutes a force transmission means which connects the weight 44 to the press arm 46 in essentially the same manner as in the marketed exercise machine, whereby the force which must be exerted on the hand grips 52 of the press arm 46 to move the arm forwardly (to the right in FIGS. 1 and 4–6) against the resisting force F exerted on the arm by the weight 44 substantially equals the magnitude of the weight. This resisting force urges the exercise member 14 rearwardly (to the left in FIGS. 1 and 4–6) to the normal position of FIGS. 1 and 4.

According to a preferred feature of this invention, the press arm bracket 54 is urged away from the press arm 46, that is to the right in FIG. 3 relative to the arm, by a spring 96. The preferred spring 96 illustrated is a shock absorber-like gas spring extending longitudinally through the bracket sleeve 54 and its support 56. This spring has a plunger 98 movable in and sealed to a cylinder 100 containing a pressurized gas which urges the plunger and cylinder apart. The outer ends of the plunger and cylinder are secured by screws 102 to the outer ends of the bracket 54 and its support 56, whereby the gas spring urges the bracket away from the press arm 46.

As mentioned earlier, the exercise machine 10 has limit stop means 20 which limit rearward movement of the exercise member 14 by the resisting force F to the normal position of FIGS. 1 and 4. This limit stop means comprises a stop roller 104, preferably a rubber roller, rotatable on the common shaft of pulleys 78, 82. As shown best in FIGS. 3 and 8, this roller is disposed for engagement with a generally vertical forwardly facing edge 106 of the frame-mounted plate 76 which serves as a stop plate. Engagement of the roller 104 with the plate edge 106 directly limits rearward movement of the press arm sleeve bracket 54 by the resisting force F to the fixed limiting position shown FIGS. 1, 3, 4 and thereby limits rearward movement of the entire exercise member 14, including its press arm 46, to a normal position when sleeve bracket is fixed to the press arm. This normal position of the exercise member, and more importantly the normal position of the press arm, and hence the range of motion of the press arm along its path P of movement forwardly of the normal position are adjustable by fixing the press arm sleeve bracket 54 in different positions along its support 56 and thereby adjusting the bracket relative to the press arm 46.

The limit stop means 20 and the cable and pulley assembly 70 are constructed and arranged so that when the press arm 46 occupies its normal position, the cable 64 is free of slack with the weight 44 just resting on or raised just slightly above the next lower weight in the weight stack. In this regard, it will be recalled from the earlier description that the cable is attached to only the upper most weight in the stack, but that the exercise machine includes conventional means (not shown) for attaching any number of the weights 44 to the cable.

The exercise machine 10 is used in the following way. The user sits on the seat 28 facing forwardly toward the lower end of the press arm 46 which then occupies a normal position in front of the seat. The user grasps the lower press arm hand grips 52 and moves the press arm forwardly away from the seat against the resisting force F and rearwardly toward the seat by alternately straightening his arms and bending the arms at their elbows. The normal position which the press arm 46 occupies relative to the seat, and more importantly the normal position occupied by the press arm hand grips 52 relative to the seat, when the press arm stop roller 104 engages the edge 106 of the stop plate 76 are adjustable toward and away from the seat 28 by adjusting the press arm bracket 54 to different fixed positions relative to the press arm 46. This permits adjustment of the normal position of the press arm for the purpose of accommodating users of different body sizes and arm lengths.

The inventor claims:

1. In an exercise machine, the combination comprising:

a frame having upper and lower portions, a seat on said lower frame portion at one side of said frame, a press arm at said one side of said frame having an upper end adjacent said upper frame portion and a lower end adjacent said seat, means pivotally mounting the upper end of said press arm on said upper frame portion above said seat for pivotal movement of said lower end of said press arm inwardly toward and outwardly away from said frame side and movement of said lower press arm end along an arcuate exercise path toward and away from said seat, an elongate support arm rigidly secured at one end to said press arm and extending laterally of said press arm toward said frame, a sleeve member adjustable endwise along said support arm toward and away from said frame relative to the press arm, means for releasably securing said member in different fixed positions along said support arm for movement of said press arm and said member in unison toward and away from said frame in each fixed position of said member along said support arm, a stop on said frame, means on said member engagable with said stop for limiting movement of said member toward said frame, and force exerting means connected between said frame and said member for yieldably urging said member toward said frame and yieldably resisting movement of said member away from said frame.

2. The combination according to claim 1 wherein said force exerting means comprises:

a weight, means movably supporting said weight on said frame for up and down movement relative to the frame, a cable and pulley system connecting said member and said weight in such manner that movement of said member away from said frame raises said weight and movement of said member toward said frame lowers said weight, whereby said weight urges said member toward said frame and resists movement of the member away from said frame, and wherein said cable and pulley system includes pulleys rotatably mounted on said frame and member, and a cable trained about said pulleys and secured to said weight.

3. The combination according to claim 2 wherein:

said member is slidable endwise along said support arm and secured against rotation about the longitudinal axis of said support arm by the arm and sleeve member being non-circular in cross-section.

4. The combination according to claim 2 wherein:

said member comprises a sleeve slidable endwise along said support arm and secured against rotation about the longitudinal axis of said support arm by the arm and sleeve member being non-circular in cross-section.

5. The combination according to claim 1 wherein: said member has a first end adjacent said press arm and an opposite end, said force exerting means comprises a weight, means movably supporting said weight on said frame for up and down movement relative to the frame, and a cable and pulley system connecting said member and said weight in such manner that movement of said member away from said frame raises said weight and movement of said member toward said frame lowers said weight, whereby said weight urges said member toward said frame and resists movement of the member away from said frame, and wherein said cable and pulley system includes a first pulley rotatably mounted on said frame over said member, a second pulley rotatably mounted on and above said first end of said member, a third pulley rotatably mounted on said frame adjacent said opposite end of said member, a fourth pulley rotatably mounted on and above said first end of said member coaxially with said second pulley a fifth pulley rotatably mounted on said frame adjacent said opposite end of said member, and a cable having a first end fixed to said frame at a position on the frame adjacent said first pulley and extending from said position, around said first, second, third, fourth, and fifth pulleys in order and then to said weight.

6. The combination according to claim 5 wherein:

the plane of said third pulley is inclined relative to the planes of said second and fourth pulleys to provide a smooth transfer of said cable between said second, third, and fourth pulleys.

7. The combination according to claim 1 wherein:

said sleeve member is slidable along said support arm.

8. The combination according to claim 1 wherein:

said member comprises a sleeve slidable endwise along said support arm.

9. In an exercise machine, the combination comprising:

a frame including a normally lower base, a frame member extending normally upward from said base and having a normally lower end rigidly joined to said base and a normally upper end, and a normally upper cantilever arm rigidly joined at one end to the upper end of said frame member and extending beyond one side of said frame, a seat on said one side of said frame below said cantilever arm, a press arm having a normally upper end adjacent said cantilever arm, a normally lower end adjacent said seat, and one side facing said one side of said frame, means pivotally mounting the upper end of said press arm on said cantilever arm for pivotal movement of said press arm toward and away from said frame and movement of said lower press arm end along an arcuate exercise path toward and away from said seat, an elongate bracket support arm rigidly secured at one end to said one side of paid press arm between the ends of the press arm and extending laterally of said press arm toward said frame, a bracket sleeve slidable on said bracket support arm for extension toward and retraction away from said frame relative to press arm, means for releasably securing said sleeve in different fixed positions along said support arm, a stop member secured to and depending from said cantilever arm between the upper ends of said frame member and said press arm, means on said bracket sleeve engagable with said top member for limiting pivotal movement of said press arm toward said frame, a weight, means movably supporting said weight on said frame for normally vertical movement relative to the frame, a cable and pulley system connecting said press arm and said weight in such manner that pivotal movement of said press arm away from said frame raises said weight and pivotal movement of said press arm toward said frame lowers said weight, whereby said weight urges said press arm toward said frame and resists pivotal movement of the press arm away from said frame, and wherein said cable and pulley system includes pulleys rotatably mounted on said frame and bracket sleeve, and a cable trained about said pulleys and secured to said weight, and said means on said bracket sleeve engagable with said stop member comprises a shaft rotatably mounting a said pulley on said bracket sleeve.

10. In an exercise machine, the combination comprising:

a frame including a normally lower base, a frame member extending normally upward from said base and having a normally lower end rigidly joined to said base and a normally upper end, and a normally upper cantilever arm rigidly joined at one end to the upper end of said frame member and extending beyond one side of said frame, a seat on said one side of said frame below said cantilever arm, a press arm having a normally upper end adjacent said cantilever arm, a normally lower end adjacent said seat, and one side facing said one side of said frame, means pivotally mounting the upper end of said press arm on said cantilever arm for pivotal movement of said press arm toward and away from said frame and movement of said lower press arm end along an arcuate exercise path toward and away from said seat, an elongate bracket support arm rigidly secured at one end to said one side of said press arm between the ends of the press arm and extending laterally of said press arm toward said frame, a bracket sleeve slidable on said bracket support arm for extension toward and retraction away from said frame relative to press arm, means for releasably securing said sleeve in different fixed positions also said support arm, a stop member secured to and depending from said cantilever arm between the upper ends of said frame member and said press arm, means on said bracket sleeve engagable with said stop member for limiting pivotal movement of said press arm toward said frame, a weight, means movably supporting said weight on said frame for normally vertical movement relative to the frame, a cable and pulley system connecting said press arm and said weight in such manner that pivotal movement of said press arm away from said frame raises said weight and pivotal movement of said press arm toward said frame lowers said weight, whereby said weight urges said press arm toward said frame and resists pivotal movement of the press arm away from said frame, and wherein said cable and pulley system includes pulleys rotatably mounted on said stop member, on the upper end of said frame member, and on said bracket sleeve, respectively, and a cable trained about said pulleys and secured to said weight.

11. In an exercise machine, the combination comprising:

a frame including a normally lower base, a frame member extending normally upward from said base and having a normally lower end rigidly joined to said base and a normally upper end, and a normally upper cantilever arm rigidly joined at one end to the upper end of said frame member and extending beyond one side of said frame, a seat on said one side of said frame below said cantilever arm, a press arm having a normally upper end adjacent said cantilever arm, a normally lower end adjacent said seat, and one side facing said one side of said frame, means pivotally mounting the upper end of said press arm on said cantilever arm for pivotal movement of said press arm toward and away from said frame and movement of said lower press arm end along an arcuate exercise path toward and away from said seat, an elongate bracket support arm rigidly secured at one end to said one side of said press arm between the ends of the press arm and extending laterally of said press arm toward said frame, a bracket sleeve slidable on said bracket support arm for extension toward and retraction away from said frame relative to press arm, means for releasably securing said sleeve in different fixed positions along said support arm, a stop member secured to and depending from said cantilever arm between the upper ends of said frame member and said press arm, means on said bracket sleeve engagable with said stop member for limiting pivotal movement of said press arm toward said frame, a weight, means movably supporting said weight on said frame for normally vertical movement relative to the frame, a cable and pulley system connecting said press arm and said weight in such manner that pivotal movement of said press arm away from said frame raises said weight and pivotal movement of said press arm toward said frame lowers said weight, whereby said weight urges said press arm toward said frame and resists pivotal movement of the press arm away from said frame, and wherein said cable and pulley system includes a first pulley rotatably mounted on said bracket sleeve, a second pulley rotatably mounted on said stop member, and a third pulley mounted on said bracket sleeve, and a cable trained about said pulleys and secured to said weight, and said means on said bracket sleeve engagable with said stop member comprises a shaft rotatably mounting said third pulley on said bracket sleeve.

12. The combination of claim 11 including:

spring means for urging said sleeve along said bracket arm away from said press arm.

* * * * *